US006070906A

United States Patent [19]

Allen

[11] Patent Number: 6,070,906

[45] Date of Patent: Jun. 6, 2000

[54] WHEELED SKI AND EQUIPMENT CARRYING DEVICE

[76] Inventor: Thomas E. Allen, 528 Farrington's Corner Rd., Hopkinton, N.H. 03229

[21] Appl. No.: 08/852,980

[22] Filed: May 7, 1997

[51] Int. Cl.[7] ..... A63C 11/02

[52] U.S. Cl. ..... 280/814; 280/47.19; 280/645

[58] Field of Search ..... 280/814, 815, 280/47.131, 47.17, 47.18, 47.19, 47.315, 63, 79.3, 79.7, 645, 646; 224/917

[56] References Cited

U.S. PATENT DOCUMENTS

| | | | |
|---|---|---|---|
| 2,956,813 | 10/1960 | Madden | 280/815 |
| 3,596,922 | 8/1971 | Luttrell | 280/47.131 |
| 3,779,568 | 12/1973 | Wakabayashi | 280/814 |
| 3,865,392 | 2/1975 | Hartway | 280/35 |
| 4,114,915 | 9/1978 | Lello et al. | 280/47.19 |
| 4,126,255 | 11/1978 | Olson | 280/814 |
| 4,171,079 | 10/1979 | Dietlein et al. | 280/814 |
| 4,268,050 | 5/1981 | Kennedy, Sr. | 280/814 |
| 4,358,137 | 11/1982 | Gramm | 280/814 |
| 4,540,198 | 9/1985 | Kyburz | 280/814 |
| 4,553,779 | 11/1985 | Shortridge | 294/147 |
| 4,666,184 | 5/1987 | Garvey, Jr. | 280/814 |
| 4,705,281 | 11/1987 | Spinas | 280/814 |
| 4,759,559 | 7/1988 | Moulton | 280/40 |
| 4,792,159 | 12/1988 | Garvey, Jr. et al. | 280/814 |
| 4,842,289 | 6/1989 | Samuels | 280/8 |
| 4,848,782 | 7/1989 | Schmidt | 280/47.131 |
| 4,856,811 | 8/1989 | Bressler et al. | 280/652 |
| 4,968,060 | 11/1990 | Rooney | 280/814 |
| 5,005,847 | 4/1991 | King et al. | 280/47.19 |
| 5,106,112 | 4/1992 | Sargent | 280/40 |
| 5,114,165 | 5/1992 | Vogel | 280/47.331 |
| 5,207,441 | 5/1993 | Granberry | 280/204 |
| 5,340,153 | 8/1994 | Parker | 280/814 |
| 5,348,327 | 9/1994 | Gieske | 280/47.331 |

FOREIGN PATENT DOCUMENTS

| | | | |
|---|---|---|---|
| 156282 | 4/1938 | Austria | 280/814 |
| 443498 | 4/1927 | Germany | 280/814 |
| 581487 | 11/1976 | Switzerland | 280/814 |
| 86/07275 | 12/1986 | WIPO | 280/814 |

*Primary Examiner*—Daniel G. DePumpo
*Assistant Examiner*—Frank Vanaman

[57] ABSTRACT

A ski transporting device which can carry three or more pair of skis, boots and poles. The device comprises three main components; 1, a two wheeled component detachably mounted to 2, a main or spine pair of skis and 3, a spanner support bar again detachably mounted to the spine pair of skis. This bar supports two or more additional pairs of skis which, in conjunction with the main pair, form a cradling space in which additional skis, ski poles and boots can stored and thus transported. An optional handle mounts on the opposite end of the main pair of skis to facilitate pulling the loaded device.

18 Claims, 6 Drawing Sheets

Fig. 6
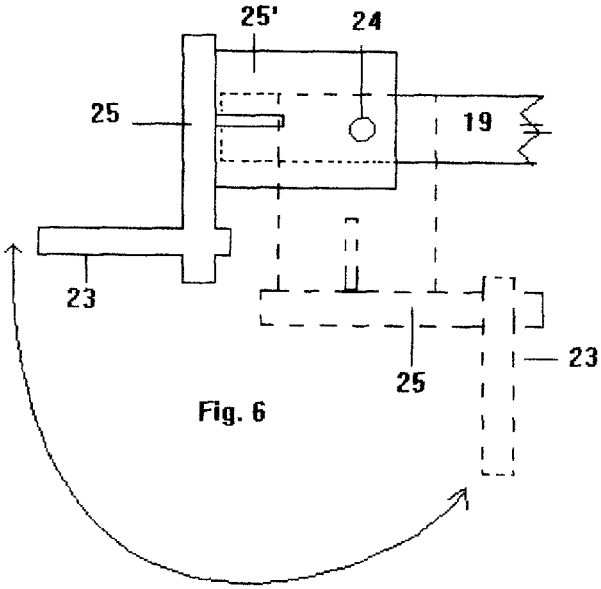
Fig. 6
Fig. 6A
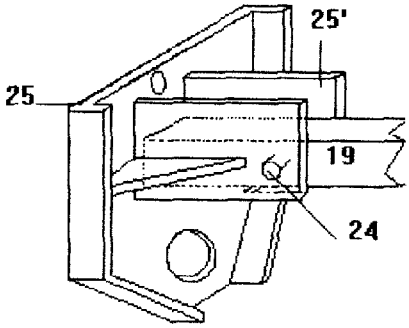
Fig. 7
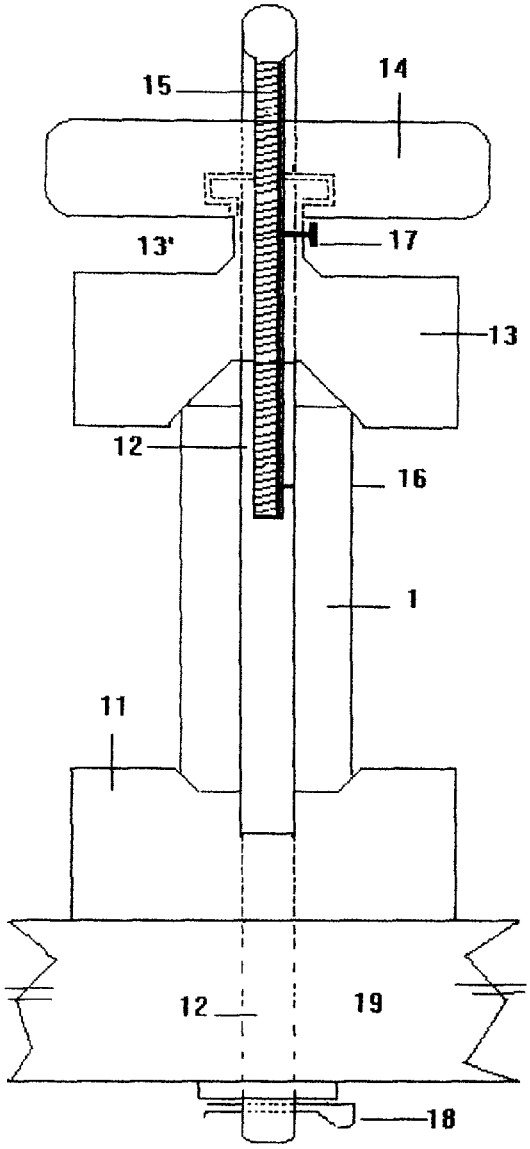

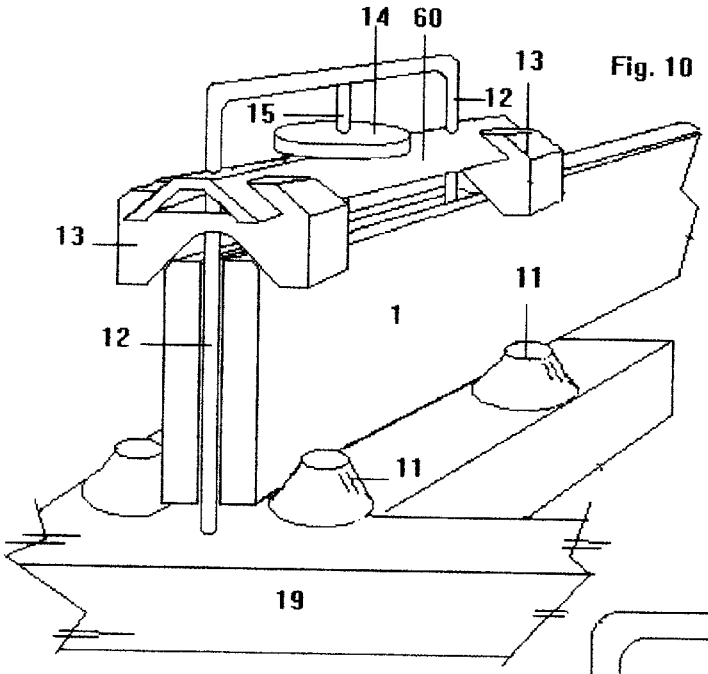
Fig. 10
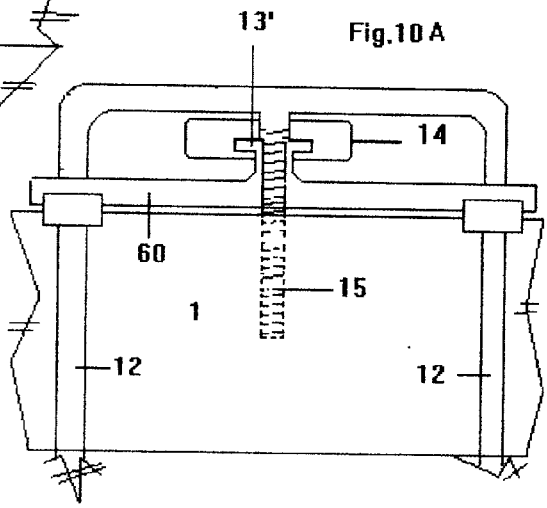
Fig.10 A
Fig. 10 B
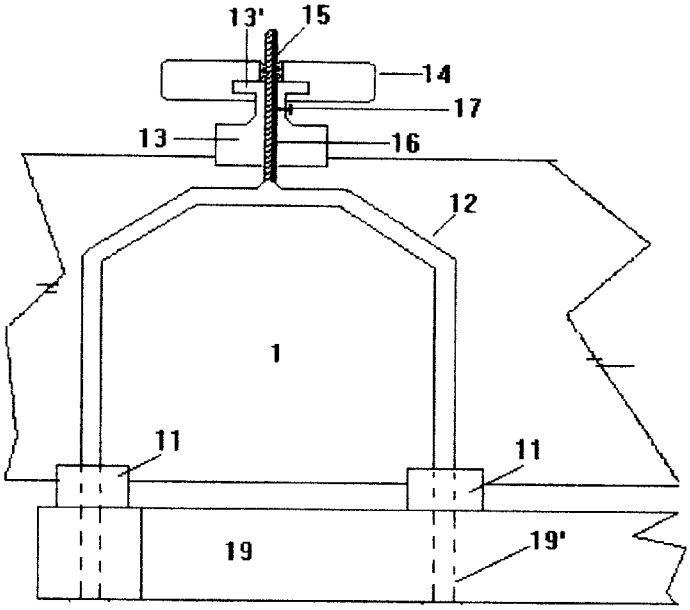

WHEELED SKI AND EQUIPMENT CARRYING DEVICE

BACKGROUND OF INVENTION

This invention relates specifically to a wheeled apparatus for transporting skis and related equipment.

Skiers need to carry lots of equipment when they go to the slopes. If these people are parents with smaller children then they must also carry the little one's share. This can take lots of the fun out of the day's adventure. It can also be dangerous what with whirling skis and sharp ski poles. It seems that there is a need for a device which can safely transport a variety of ski equipment and be conveniently stored away in a very small area.

Parker, U.S. Pat. No. 5,340,153, discloses a ski carrier that will carry two pair of skis on a wheeled dolly similar to the type used to transport utility poles behind a truck. That is, attach one end of the long object to a pair of wheels and attach the opposite end to a vehicle.

Garvey Jr, U.S. Pat. Nos. 4,666,184 and 4,792,159 discloses a two wheeled carrier for a single pair of skis and Kybutz, U.S. Pat. No. 4,540,198 discloses a one wheel device for a single pair of skis. All of these devices are adequate for their intended uses but fall far short of the goal of this invention; to provide a multi-purpose cart that can not only carry three or more pair of skis, boots and poles but can also be used to carry other gear.

SUMMARY OF THE INVENTION

One object of the invention is to provide a carrier that will overcome the limitations of the prior art devices.

Another object of the invention is to provide a compact ski carrier that will transport three or more pairs of skis, boots and poles safely and easily to the desired location.

Like the aforementioned devices of Parker and Garvey and the utility pole carrier, the present invention comprises the concept of a two wheeled device attached to one end of a pair of skis. Unlike Parker's device, the current invention mounts the pair of skis in a rigid, non flexing on-edge position rather than on a flat and flexible position. This method affords much greater strength and a more secure attachment to the device. This on edge position prevents natural ski flexing movement which will scratch and eventually wear the finish and worse, loosen the skis from the device.

Unlike Parker, this invention also comprises a horizontal support structure which mounts at the center of a main or first pair of skis and supports two or more pairs of skis along with poles and boot bags etc. The on edge position of the main or first pair of skis also provides the horizontal support structure with a much more rigid surface area to grip. Parker's device as disclosed is not capable or transporting more than two pair of skis without major design changes. Furthermore, both pair of skis on Parker's device must be nearly the same length. This restricts the use to two people of the same height, which effectively eliminates parent and child, the group that would gain the most advantage from the invention.

Unlike Parker, who hangs the boots at the user's hand, the ski boots and other equipment carried by this invention are contained in readily available boot bags which can be carried in the cradle formed by the three pair of skis. The load is over the wheels of the device and not at the arm area of the user. This makes the weight of the boots negligible. The boots are secure and do not swing with the walking gait of the user as they would with Parker's device.

Like Parker, one embodiment of this invention comprises a handle, albeit optional, to pull the device along. Parker's handle is a multi piece affair which again mounts on the skis in a horizontal and flexing manner rather than a vertical and rigid manner. Again, the device will surely loosen over a period of rough and sustained pulling because of the nature of ski design.

When laid on a flat surface and viewed from the side all top surfaces of modern skis taper from thick in the middle boot binding area to thin at each end. The front tips then flare steeply upward and the tails flair slightly upward. Unless the handle and wheel device are attached with extreme torque, in exactly the right position, the push-pull action will begin to loosen the skis. Once this motion begins the shape of the ski will assist and accelerate the loosening process. This will inevitably scratch the skis' top face and ultimately detach the carrier.

Unlike Parker, this invention comprises a simple one piece handle which surrounds the sides and edges of the skis. The handle easily slides over the tails of the first pair of skis and installs in seconds. It can be placed in varying positions to suit the user. The design of modern skis coupled with the handle's unique design tightens the grip on the ski's side when the handle is pulled or lifted. As mentioned before the handle is optional and is used merely to enhance the pulling and gripping power on a fully loaded carrier. The invention will function in its basic application without the handle. Parker's device needs the handle to balance the loaded carrier.

The current invention's embodiment is both simple and easy to use. Unlike Parker's device, this invention can be easily attached to the first pair of skis at home and then transported to the ski area on the roof rack of the vehicle. Parker's device needs both pair of skis and the handle attached in order to provide stability when lifting the unit on or off the vehicle's rack, a heavy load for one person to lift.

This invention can be attached to the first pair of skis in the parking lot while standing upright rather than having to lay the device on the ground. This is because the carrier frame is formed in a T configuration. The user can easily hold the vertical section of the T and the first pair of skis in one hand while the other hand tightens the clamping device. From Parker's drawings it would appear that the device would have to be laid on the ground when trying to mount it to the skis. It further seems that it might require two people to accomplish this task.

As mentioned before, Parker mounts his skis on the flat. This method requires that the tips be located at the user end of the device. Otherwise, from the drawings it would appear that the ski tips of the bottom skis would flare downward reducing the ground clearance by about half. This would cause the tips to snag on rougher terrain with abrupt transitions like one finds at a ski area.

Further objectives and advantages will become evident as one studies the detailed description and drawings.

BRIEF DESCRIPTION OF DRAWINGS

FIG. 6 shows a folding axle assembly.

FIG. 6A shows the current embodiment's detail of the folding axle assembly.

FIG. 7 shows one embodiment of the ski carrier's three jaw ski clamping assembly.

FIGS. 10 and 10A show a four jaw embodiment of the ski clamping assembly.

FIG. 10B shows a different embodiment of the three jaw ski clamping assembly.

DETAILED DESCRIPTION OF PREFERRED EMBODIMENTS

The carrying device is comprised of three main elements used in combination to form a ski carrying device:

1. A two wheeled component with attachment and support means for one end of a first pair of skis and support and attachment means for the ends of additional pairs of skis flanking the first pair of skis.
2. The first pair of skis form the frame of the carrying device.
3. A horizontal support structure placed mid section of the first pair of skis to support the opposite ends of the additional pairs of skis.

Figure 1:
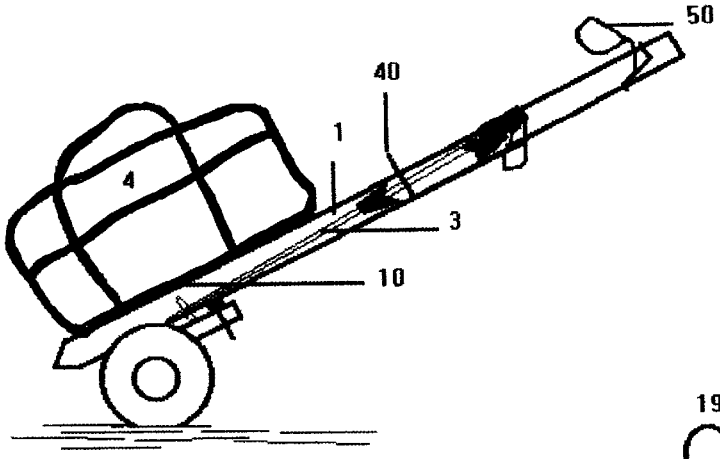
FIG. 1 shows the invention carrying ski poles and boot bag with the first pair of skis mounted on edge with the horizontal support structure and optional pulling handle in place.

FIG. 1 shows the invention in its operating position. The inverted U shaped clamping assembly 10 detachably clamps the tip end of the first pair of skis to the wheeled component. Horizontal support structure 40 slips over the first pair of skis at the binding area and is held in position by friction. Handle 50, is slipped over the tails of the first pair of skis 1. However, this handle is not needed to achieve basic operation of the carrier.

Figure 1A:
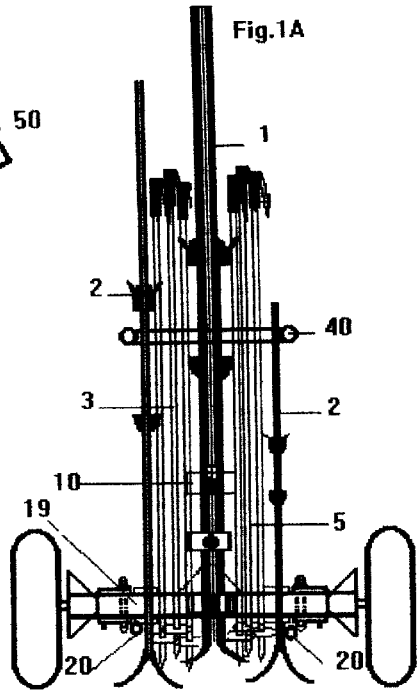
FIG. 1A shows top view of carrier loaded with two pairs of flanking skis and poles.

In FIG. 1A, additional pairs of skis 2, are placed on edge upon the horizontal support structure 40 and on the rear flanking support bars 20. The combination of these three pairs of skis creates a cradle like area 5 where ski poles 3 and a boot bag 4 can be supported.

Figure 2:
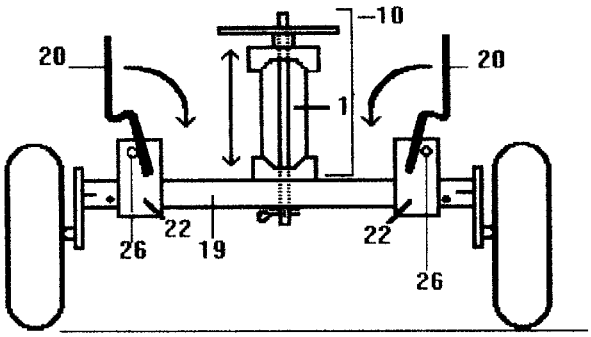
FIG. 2 shows a rear view of carrier in operating position with clamping assembly and flanking ski support bars extended.
Figure 2A:
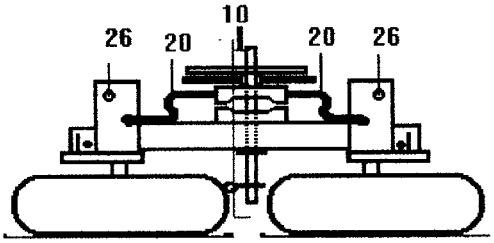
FIG. 2A shows carrier in folded storage position.

FIG. 2 shows a rear sectional view of the invention in operating position with the first pair of skis 1 attached by means of clamp assembly 10. When not in use, the invention can be folded for easy storage by pushing assembly 10 down through the T shaped frame 19 and folding the support bars 20 down to their resting position. FIG. 2A.

Figure 3:
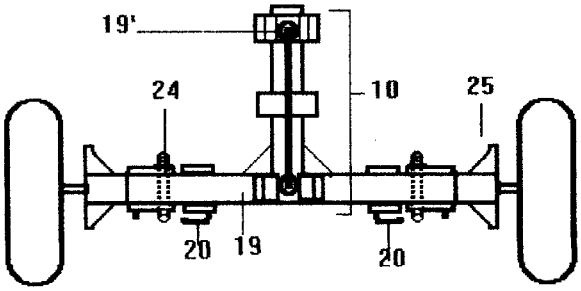
FIG. 3 shows a top sectional view of the T shaped carrier in operating position.

FIG. 3 is a top sectional view of the T shaped main frame of the carrier.

In FIGS. 6 and 6A, the axle mounting plate assembly 25 serves to both hold the axle to the main frame 19 and increase the carrier's ground clearance. The axle mounting plate assembly pivots to the folded position on shaft 24, FIG. 6. The inside walls and bottom of the channel 25' of the axle assembly rest against the side walls and bottom of the main frame 19. The weight of the carrier and its load keep the two assemblies effectively locked together forming a rigid, continuous bar. To permit the axle assembly to fold under at a 90 degree angle, the inner end section of the bottom of channel 25' has been removed. This section's length is approximately the same as the height of the side wall of frame 19.

Figure 4:
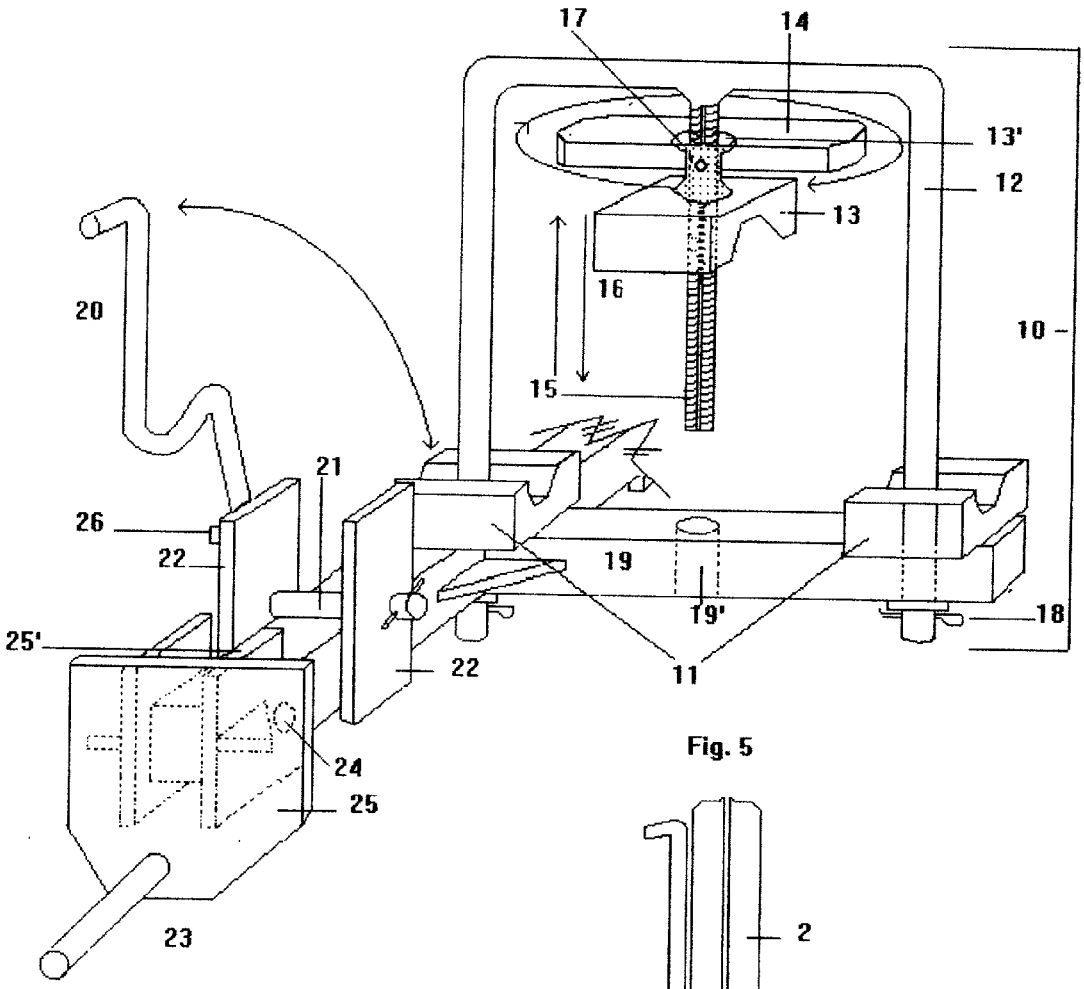
FIG. 4 shows the carrier in isometric view without wheels.

FIG. 4 is one embodiment of a three jaw clamping assembly and FIG. 10*b* is another three jaw clamping assembly. FIG. 10 is a four jaw clamp. The clamp arms 12, are shaped like an inverted U and are very similar in operation. The arms of the inverted U shaped clamping device 10. FIG. 4 have slideable engagement with the mainframe 19 via two holes through its surface as does the four jaw assembly in FIG. 10. The cross view of the three jaw clamp, FIG. 7, shows clamping device arms 12 passing through mainframe 19 and lower clamping jaws 11, and secured with stopping element, a cotter key and washer 18. The clamp arms 12 can be secured in a number of ways, however the travel of the clamp arms 12 must be adjustable since widths of the first pair of skis will vary. Clamp arms 12 must be able to travel freely up and down in order to make attachment of the first pair of skis a simple process. All of the above applies to the four jaw assembly as well.

In FIG. 7 and FIG. 10 a threaded rod 15 is welded or other wise rigidly attached to the center of the U shaped clamp arms 12. The diameter of the threaded rod is slightly less than the diameter of the clamp arms 12. A threaded element, such as a spinner or knob 14, can travel up or down rod 15. A cavity in the bottom of spinner 14 houses a flange 13' which is a protrusion of top jaw 13. This flange is rather loosely housed to allow spinner 14 to rotate around threaded rod 15 and the flange 13'. As the spinner travels up rod 15 the lip of the cavity in 14 pulls up on the bottom lip of 13' thus pulling jaw 13 up and loosening the clamp. When the clamp is tightened the top of the cavity in 14 pushes down on the top of the flange and urges jaw 13 down on to the top edge of the first pair of skis 1.

For ease of operation jaw 13 should remain parallel with opposing jaws 11. This can be done by means of a key 17 in the flange 13' and a way or slot 16 in the threaded rod 15. As the cavity in spinner 14 moves jaw 13 up or down, it is natural that the flange 13' rotate in unison with the knob 14. However, the key 17 traveling in the way 16 in the rod 15 keeps the jaw 13 from rotating. The jaw moves up and down in a more or less fixed, non rotating position.

In order for the carrier to carry heavy loads and travel over rough terrain it is again imperative that the first pair of skis' attachment to the carrier be absolutely rigid. This is accomplished in all clamp embodiments by the shape of the jaws 11 and 13 and their relation to the clamp arms 12. The upper jaw 13 has a center portion with a through hole and two downwardly inclined outer portions. The through hole is sized to slidably engage the threaded rod 15. The lower jaws 11 each have a center portion with a through hole and two upwardly inclined outer portions. The through holes are sized to allow slidable engagement on the clamp arms 12. As jaws 11 and 13 are tightened by rotating spinner 14, the slope of the jaw's contact area forces the first pair of skis down and inward where the bottoms of the skis make contact with the surface of arms 12. As further tightened the ends of the clamp arms 12 pull against mainframe 19 forcing the skis further down and squeezing them against arms 12 making the entire assembly 10 very rigid. Because of the tapered shape of modern skis, the harder the first pair of skis are pulled, the more the clamp tightens.

FIG. 10 shows a similar embodiment of the ski clamping device. FIG. 10 is a four point device where the bar 60 that rides up and down clamp arms 12 simply keeps the upper jaws 13 from rotating rather than a key and way. Spinner 14 when rotated forces the bar 60 down and it in turn forces the jaws to tighten on the first pair of skis 1. The bar has a protruding flange housed in the bottom of spinner 14 to pull the bar up and loosen the clamp when the spinner is rotated in the opposite direction.

FIG. 10B is a three point device that works like the clamp of FIG. 7. It utilizes the key and way method of keeping the upper 13 jaw parallel to the lower jaws 11. Its clamping arms 12, however, remain below the top edges of the first pair of skis skis 1 allowing the upper jaw 13 to tightly grip the skis before it reaches the end of the threaded rod 15.

Figure 5:
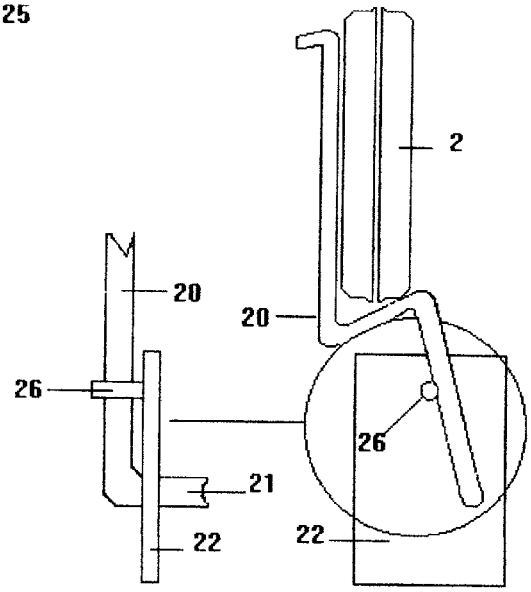
FIG. 5 shows a rear view of rear flanking ski support bar.

FIG. 2 and FIG. 5 show the rear view of an embodiment of the flanking ski support form 20 in the upright and holding position. The current embodiment is a shaped rigid rod. The flanking pair of skis rest in the saddle of the rod 20, FIG. 5. The pivot point of the rod, is offset so as to cause the weight of the supported skis to force the rod's arm down and to the out side of the carrier. There it contacts stop 26 and is restricted from traveling any further in its arch. The weight of the skis, coupled with the offset pivot point, allows the skis center of gravity to effectively lock the rod in position against 26 with no additional mechanisms. When rotated in the opposite direction or to the inside of the carrier, the rod will travel 100 plus degrees to its folded or prone position FIG. 2A.

Figure 8:
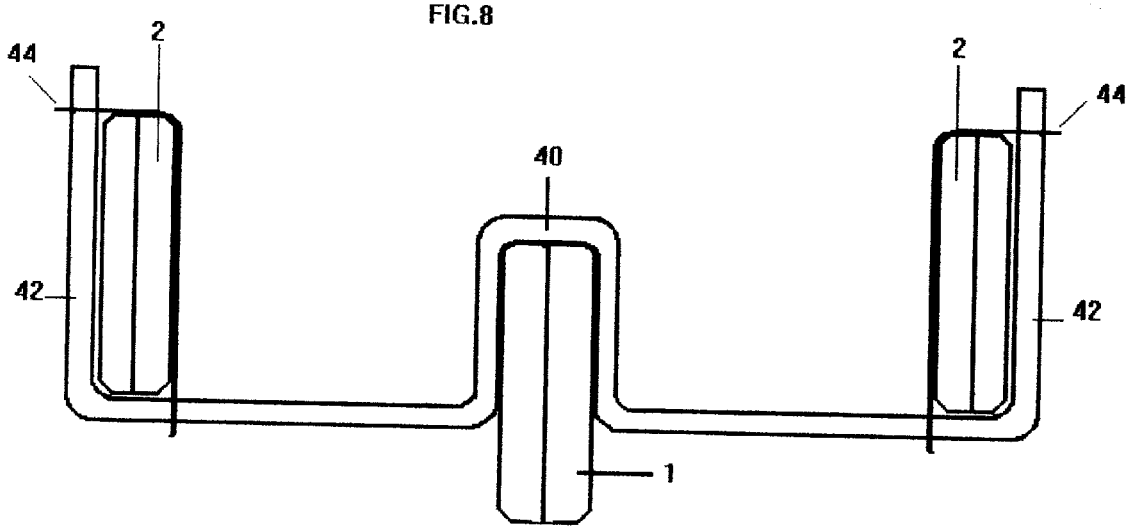
FIG. 8 shows an embodiment of a horizontal support structure.

FIG. 8 shows the front and rear view of an embodiment of the one piece horizontal support structure 40 resting on the mid section of the first pair of skis 1. The horizontal support structure 40 is held in position by the frictional contact between the U shape section of the bar and the skis. Rubber or like material should coat the bar to prevent marring and to increase the friction between the horizontal support structure and the skis. The flanking skis 2 rest on the horizontal rib and are secured against the upturned end 42 by means of a rubber type strap 44. Any like form could be employed for this horizontal support structure, as long as the skis remain secure in a position to maintain rigidity of the cradle area 5, FIG. 1A.

Figure 9:
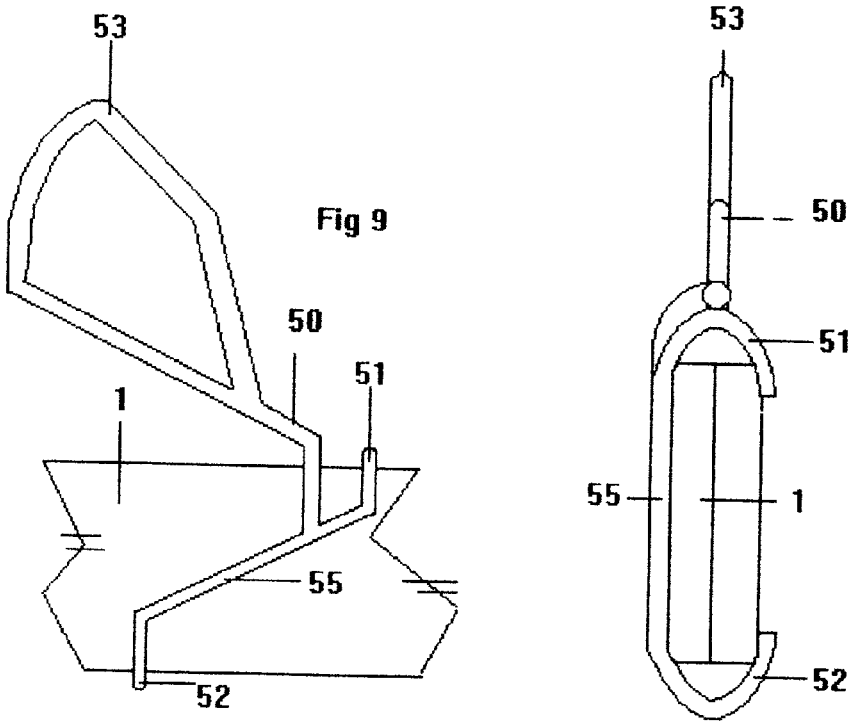
FIG. 9 shows an embodiment of a handle which can mount to the first pair of skis.

FIG. 9 discloses a one piece handle that can be used to enhance the pulling force exerted by the users hand. It simply slides over the tails of the first pair of skis. It comprises two sections. One section comprising 51 at one end and 52 at the other end is formed by a round rod of rigid material bent such that its end sections are, more or less, at right angles to the skis' edge 1. These ends are bent back over on themselves to form U shapes that are substantially perpendicular to the tops or flat side of the skis. These U shapes cradle the pair of skis in the bottom of the U shape. The loop shaped handle section has a straightened bottom section downwardly inclined. It is rigidly attached to a short section which is substantially perpendicular to the edge area of the first pair of skis. This short section is rigidly attached to the upper area of the rod between 51 and 52. As the handle is lifted and/or pulled forward, torque is transferred to the bar between 51 and 52. This causes section 51 to bear down on the top edge of the skis 1. At the same time the torque causes the section 52 to press up on the bottom edge of the skis 1. As this force is applied the angled inside walls of the U shaped end 51 forces the skis downward and inward while the angled inside walls of the U shaped section 52 force the skis upward and inward. This combination of forces squeezes the skis further together thus providing constantly self adjusting tension upon the skis. When the lifting and/or pulling force is removed the handle automatically loosens for easy removal.

Figure 9A:
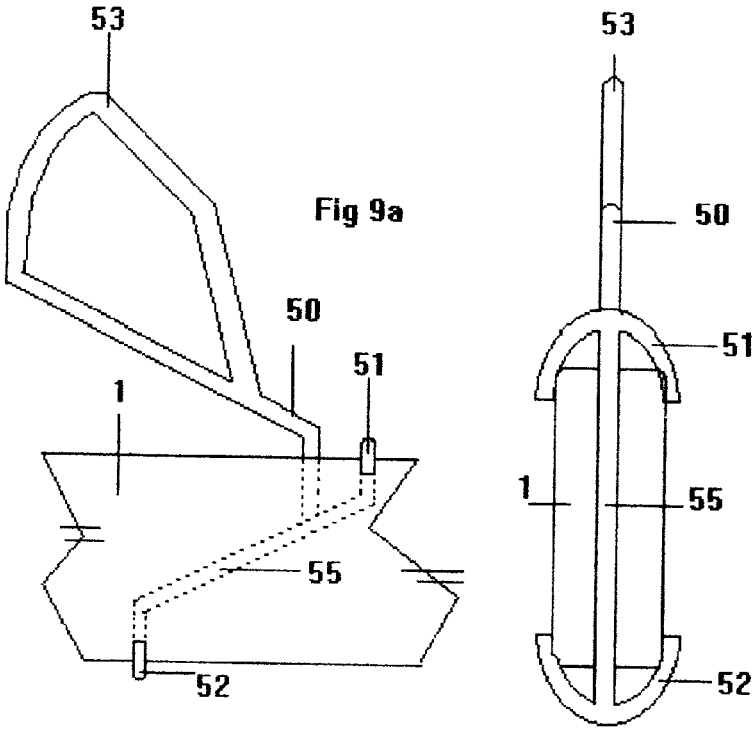
FIG. 9A shows a slightly different embodiment of the handle of FIG. 9.

FIG. 9A shows a slightly different embodiment of the handle of FIG. 9. The U shape ends 51 and 52 of rod section 55 are bisected where rod 55 is between the skis rather than along one side of the skis. The sides of the U shape force the bottoms of the skis against the rod 55 rather than against each other.

It is evident that the above described details are specific to the preferred embodiment of the invention. However, it should be understood that these should not be construed as limiting the scope of the invention. For example the horizontal support structure could be a solid rectangle with notches cut out to engage the skis and poles or the skis could be secured to the horizontal support structure with spring loaded clamps. The handle could fit between the first pair of skis' tails and grip the edges or a strap could encircle the tails to aid in pulling.

Thus the scope of the invention should be determined by the appended claims and their legal equivalents, rather than by the examples given.

I claim:

1. A ski carrying device and pair of skis, comprising, in combination:

a two wheeled component, a main pair of pair of skis, and a horizontal support structure;

said two wheeled component comprising a surface having axle means and wheels, attachment and support means for engaging a first end of said main pair of skis, a separate second support means adapted to engage first ends of at least two further pairs of skis, said second support means disposed on opposite sides of said attachment and first support means;

said first pair of skis comprising a frame component of the carrying device, said first pair of skis being detachably fixed to said attachment and first support means on said surface of said two wheel component, each of said first pair of skis mounted closely proximate one another with respective bottom surfaces facing, lateral side edges of said first pair of skis engaging said two wheeled component, said first pair of skis oriented with said respective bottom surfaces substantially perpendicular to said axle means;

said horizontal support structure detachably affixed to, and extending transversely from, a mid section of said first pair of skis, said horizontal support structure further comprising further support and securing means located on opposite sides of said first pair of skis, adapted to support second ends of said at least two further pairs of skis.

2. The combined carrying device and skis of claim 1, wherein said surface of said two wheeled component comprises a substantially T shaped frame, comprising a horizontal top member and a vertical base member, wherein said axle means, being oriented perpendicularly to the bottom surfaces of said first pair of skis, is disposed on said top member.

3. The combined carrying device and skis of claim 2 wherein said axle means is disposed at each end of said top member of said T shaped frame.

4. The combined carrying device and skis of claim 3 wherein said axle means disposed at each end of said top member of said T shaped frame has supporting structure with pivoting means to allow said axle means and said wheels to fold against said T shaped frame.

5. The combined carrying device and skis of claim 1 wherein said surface of said two wheel component has two holes longitudinally disposed along a line in a center area of said surface, said line substantially perpendicular to said axle means, said two holes extending through said surface of said two wheeled component.

6. The combined carrying device and skis of claim 1 wherein said attachment and support means for said first pair of skis is a ski clamping assembly, said ski clamping assembly comprising;

an inverted U shaped device with a threaded rod affixed to a center area of said inverted U shaped device, said threaded rod extending from said center area along a line parallel to and on the same plane as the arms of said inverted U shaped device, the diameter of said threaded rod being less than the diameter of said arms of said inverted U shaped device; said threaded rod having a key way running along its length, an upper clamping jaw, said upper clamping jaw having a center portion with a through hole and two downwardly inclined outer portions, said through hole sized to allow said upper clamping jaw slideable engagement on said threaded rod;

a flanged protrusion extending upwardly from a top area of said upper clamping jaw and slideably engaging said threaded rod, said flanged protrusion having a key to engage said key way on said threaded rod;

a spinnable threaded element engaged on said threaded rod above said upper clamping jaw said threaded element having a cavity on its underside to loosely capture said flanged protrusion of said upper clamping jaw;

two lower clamping jaws, each lower clamping jaw comprising;

a center portion with a through hole and two upwardly inclined outer portions; said lower clamping jaws longitudinally disposed on a center area of said surface of said two wheeled component, said through holes of said lower clamping jaws aligned with a pair of holes through said surface of said two wheeled component;

a longitudinally adjustable and detachable stopping element on each end area of said arms of said inverted U shape device.

7. The combined carrying device and skis of claim 6 wherein both arms of said U shaped device are slideably engaged in said through holes of said lower clamping jaws and said holes through said surface of said two wheeled component, said adjustable and detachable stopping elements are detachably mounted to the ends of said arms of said inverted U shaped device on the underside of said surface of said two wheeled component.

8. The combined carrying device and skis of claim 1 wherein said support means for one end of said additional pair of skis comprises:

an elevated support form with saddle area, said support form extending upwardly from said surface of said two wheeled component to a predetermined height.

9. The combined carrying device and skis of claim 8 wherein said support form comprises;

an upwardly extending rigid rod with pivot means, said pivot means disposed at the bottom end of said rod, said pivot means comprising;

a bend of approximately ninety degrees in said rigid rod, the bent end of said rigid rod pivotally housed on said two wheeled component, said bent end perpendicular to said axle means;

a pivot stopping element; said pivot stopping element disposed on said two wheeled component, the position of said pivot stopping element offset from the pivot means of said rigid rod.

10. The combined carrying device and skis of claim 9 wherein said rigid rod with pivot means further comprising:

a first section of said rigid rod extending upwardly from the bottom end of said rigid rod, a second section of said rod downwardly inclined from the upper end of said first section, said second section parallel to said axle means and, a third section extending upwardly from said second section a predetermined distance.

11. The combined carrying device and skis of claim 10 wherein said pivot stopping element provides means to stop the pivoting of said rigid rod at a predetermined position along the arc of said rigid rod's pivot.

12. The combined carrying device and skis of claim 1 wherein said horizontal support structure comprises;

a one piece rod of suitable material bent to form an inverted U shaped first section, said first section of suitable size to snugly slip over and capture the mid section of said first pair of skis, said first section disposed mid section of said rod;

two horizontal ribs each extending laterally in opposite directions from each of the arms of said inverted U shaped section, both of said ribs substantially perpendicular to the first pair of skis' bottom surfaces, said ribs extending and terminating at upturned ends, said upturned ends approximately ninety degrees to said ribs, the surface of said horizontal support structure being cushioned.

13. The combined carrying device and skis of claim 12 wherein said horizontal support structure comprises securing means for said additional pairs of skis, said securing means comprising;

at least one elastic strap, one end of said at least one strap attached to at least one of said horizontal ribs in close proximity to said upturned end, the opposite end of said at least one elastic strap detachably connected to a top area of said upturned end of each said at least one horizontal rib.

14. The combined carrying device and skis of claim 1 further comprising a pulling enhancement device, said device detachably fitted to a second end of said first pair of skis, opposite said first end.

15. The combined carrying device and skis of claim 14 wherein said pulling enhancement device is fabricated from rigid rod and comprises:

a handle area, said handle area being loop shaped with a straightened bottom section inclined downwardly, the end of said bottom section rigidly fixed to a short section, said short section substantially perpendicular to said first pair of skis and rigidly fixed to the upper area of a diagonal ski gripping section, said diagonal ski gripping section diagonally traversing the top surface area of one side of said first pair of skis and terminating at a top end and a bottom end, said top end and said bottom end substantially perpendicular to the edges of said spine skis, said top and bottom ends bent over the edges of said first pair of skis to form opposing U shaped cradles where said first pair of skis is captured.

16. The combined carrying device and skis of claim 15 wherein said pulling enhancement device provides means for said device to apply a downward force to the top edges of said first pair of skis and simultaneously an upward force to the bottom edges of said first pair of skis when said handle area is lifted by a user's hand.

17. The combined carrying device and skis of claim 14 wherein said pulling enhancement device is fabricated from rigid rod and comprises:

a handle area, said handle area being loop shaped with a bottom section inclined downwardly, the end of said bottom section rigidly fixed to a short section, said short section substantially perpendicular to the edge area of said first pair of skis and rigidly fixed to the upper area of a diagonal ski gripping section, said diagonal ski gripping section diagonally traversing between the bottom surfaces of said first pair of skis and terminating at a top end and a bottom end, said top end and said bottom end substantially perpendicular to the edges of said first pair of skis, said top and bottom ends shaped to form opposing U shaped cradles where said first pair of skis is captured.

18. The combined carrying device and skis of claim 17 wherein said pulling enhancement device provides means for said device to apply a downward force to the top edges of said first pair of skis and simultaneously an upward force to the bottom edges of said first pair of skis when said handle area is lifted by a user's hand.

* * * * *